US009352376B2

(12) United States Patent
Cyrek et al.

(10) Patent No.: US 9,352,376 B2
(45) Date of Patent: May 31, 2016

(54) HEMMING HEAD DEVICE AND METHOD

(75) Inventors: Joseph P. Cyrek, Wolverine Lake, MI (US); William T. Maybee, Southfield, MI (US); Robert F. Chapman, Troy, MI (US); Kenneth D. St. Denis, Ontario (CA)

(73) Assignee: Comau S.p.A., Grugliasco (Torino) (IT)

( * ) Notice: Subject to any disclaimer, the term of this patent is extended or adjusted under 35 U.S.C. 154(b) by 949 days.

(21) Appl. No.: 13/472,545

(22) Filed: May 16, 2012

(65) Prior Publication Data

US 2012/0297854 A1 Nov. 29, 2012

Related U.S. Application Data

(60) Provisional application No. 61/489,404, filed on May 24, 2011.

(51) Int. Cl.
*B21D 39/02* (2006.01)
*B21D 19/04* (2006.01)

(52) U.S. Cl.
CPC ..... *B21D 39/023* (2013.01); *B21D 19/043* (2013.01); *B21D 39/021* (2013.01); *Y10T 29/53791* (2015.01)

(58) Field of Classification Search
CPC .... B21D 39/021; B21D 39/023; B21D 39/02; B21D 19/043; B21D 19/046; B21D 19/04; B21D 39/03; Y10T 29/53791
See application file for complete search history.

(56) References Cited

U.S. PATENT DOCUMENTS 2,091,474 A 8/1937 Elliot
4,021,909 A * 5/1977 Bollmer ..... 29/432.1
4,656,858 A 4/1987 Addison
7,121,129 B2 * 10/2006 Binggeli ..... B21D 19/046 29/243.58
7,152,447 B2 12/2006 Toeniskoetter
7,254,973 B2 † 8/2007 Campian
7,290,423 B2 11/2007 Carsley et al.
7,779,524 B2 † 8/2010 Campian (Continued)

FOREIGN PATENT DOCUMENTS

DE 102004042213 A1 3/2006
EP 2160258 3/2010

(Continued)

OTHER PUBLICATIONS

Notification of Transmittal, International Search Report and the Written Opinion of the International Searching Authority dated Oct. 24, 2012 from corresponding International Application PCT/IB2012/052562 filed May 22, 2012.

*Primary Examiner* — Shelley Self
*Assistant Examiner* — Mohammad I Yusuf
(74) *Attorney, Agent, or Firm* — Young Basile Hanlon & MacFarlane P.C.

(57) ABSTRACT

A hemming head device and method for hem forming one or more edges of deformable material. The hemming head device includes dual biasing spring members which provide a resistive force whether the hemming wheel is in a push hemming operation on an exterior joint edge or in a pull hemming operation on an interior joint edge. The device further includes a quick connect device for selectively connecting hemming wheels and other forming devices to the head and a gauge to measure the relative position or resistive force applied on the forming member by the biasing members. A method for hem forming a workpiece using dual biasing spring members is also disclosed.

17 Claims, 10 Drawing Sheets

(56) References Cited

U.S. PATENT DOCUMENTS

| | | | | |
|---|---|---|---|---|
| 7,950,260 | B2 * | 5/2011 | Kinouchi et al. | 72/220 |
| 8,024,950 | B2 * | 9/2011 | Harrow et al. | 72/220 |
| 2006/0081331 | A1 | 4/2006 | Campian | |
| 2007/0209420 | A1 | 9/2007 | Campian | |
| 2008/0302159 | A1 | 12/2008 | Toeniskoetter et al. | |
| 2009/0038361 | A1 | 2/2009 | Toeniskoetter | |
| 2009/0235712 | A1 | 9/2009 | Padmanabhan et al. | |
| 2009/0235713 | A1 | 9/2009 | Toeniskoetter | |
| 2010/0242561 | A1 | 9/2010 | Reith et al. | |

FOREIGN PATENT DOCUMENTS

| | | | |
|---|---|---|---|
| EP | 2160258 | A1 | 3/2010 |
| FR | 2895690 | A1 | 7/2007 |
| WO | 2008145396 | A1 | 12/2008 |

* cited by examiner
† cited by third party

HEMMING HEAD DEVICE AND METHOD

CROSS-REFERENCE TO RELATED APPLICATIONS

The present application claims priority benefit to U.S. Provisional Patent Application No. 61/489,404 filed May 24, 2011 the entire contents of which is incorporated herein by reference.

TECHNICAL FIELD

The general field of technology is metal forming and assembly of sheet metal components.

BACKGROUND

The forming of metal and assembly of thin sheet metal components in high volume production is a mainstay in the automotive and other fields. An example is the manufacture and assembly of automotive sheet metal doors and body panels where at least two layers of sheet steel are joined together to form an inner and outer panel with space in between for other components such as window regulators and door latches and lock assemblies.

These panels often require sealing all along the peripheral edges of the panels to keep rain, snow and wind from entering the interior compartment of the vehicle. In order to properly seal these panels, it is highly desired to have a precision sealing surface that is free from abrupt variations of the sheet metal and elimination of sharp edges from the die-cut stamped panels. It is further highly desired from a visual or aesthetic perspective to have a clean and continuous finished panel edge as the doors and body panels are the most visible on a vehicle.

Prior manufacturing and assembly processes have employed "hemming" assembly operations which generally roll or fold the edge of the outer panel around the edge of the inner panel and smash the outer panel edge back down on the inner like the sewing hem on common everyday clothing pants. This produces a relatively thin edge which is useful for the application of an elastomeric seal and/or application of aesthetic moldings or other treatments that may be applied to the finished panel.

Prior hemming devices and processes have suffered from numerous disadvantages in the devices and the processes used. Examples of these difficulties and disadvantages include keeping the roller that presses down on the finished edge in continuous contact with the contoured sheet metal while maintaining adequate pressure on the sheet metal joint to form the desired edge. Conventional hemming devices and processes also were only able to form or press down the metal edge on an exposed exterior surface and could not be used to reach into, for example, a hidden or interior edge and exert force in a pulling direction, for example in the interior surface of a door window channel. Prior devices have attempted to solve this problem with two-way hemming devices, but these devices continue to have the disadvantage of complex mechanisms and processes which do not have the precision and durability required for a high volume production environment.

Prior hemming devices also suffered from the disadvantage of having to employ structures and physical space in proximity to the component to be hemmed/worked in order to compress or preload any internal biasing mechanism in order to have the desired force applied and have the desired travel in the head to accommodate variations in the process. Prior devices suffered from the roller or corner forms wanting to raise or lift on initial contact of the metal due to an insufficient preload or resistance force provided by the biasing mechanism.

Therefore, there is a need for a hemming device head that is easily integrated into high volume production environments that solve or improve on these and other difficulties and disadvantages experienced by prior designs.

BRIEF SUMMARY

The present invention includes several examples of devices for solving or improving the above disadvantages in prior designs.

In one example of the invention, a hemming device roller head includes dual biasing members aligned along the long axis of the head housed in a preload cartridge installed in the roller head body. The biasing members are compressed and preloaded once installed and secured in the roller head body providing the necessary force resistance on initial contact of the roller or corner forms to the part to be hemmed to substantially eliminate the condition of the roller or corner forms lifting away from the hem.

In one example of the roller head, a hemming wheel quick-change mechanism is used. The quick-change mechanism allows the hemming wheels to be quickly and easily removed from the roller head either manually or automatically for replacement, cleaning or interchanging with other wheels or workpiece formers to suit the application.

In another example, a plurality of different sized corner forming tools are positioned about the roller head to increase the ability of the head to bend or form different sized component corners during the hemming process.

Examples of processes for hemming and using the inventive hemming device are also disclosed.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

Figure 1:
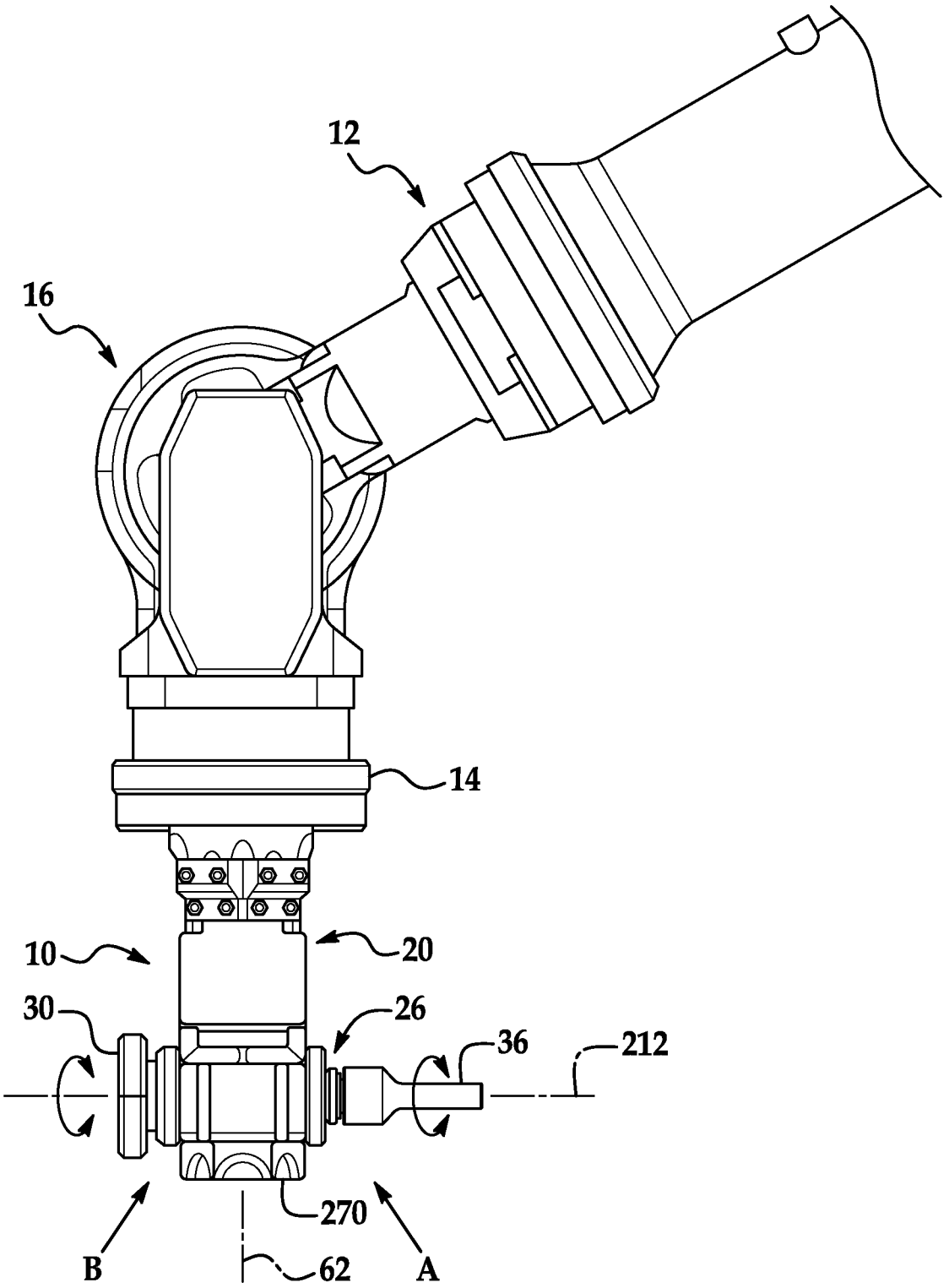
FIG. 1 is a schematic sectional view of the roller head in use with an industrial, multi-axis robot.

Examples of an inventive roller head device 10 useable in a hemming assembly process are shown in FIGS. 1-10. Referring to the FIG. 1, an example of roller hemming head 10 used in an exemplary application with a multi-axis industrial robot 12 having a wrist 16 capable of moving and articulating the head 10 in three-dimensional space is shown. In an example application, robot 12 would be electronically connected to a controller (not shown) which is preprogrammed through hardware, software and memory to move and articulate the head 10 and selected hemming wheel along a predetermined path of travel to form a desired component through a hemming-type process described further below. Hemming head 10 may be used with devices other than industrial robots to suit the particular application or specification.

Referring to FIGS. 2-6, an example of roller head 10 is illustrated. In the example, head 10 includes a circular-shaped universal mounting plate 14 with a plurality of mounting apertures suitable for use with several common industrial robot end effectors to quickly and easily connect the roller head 10 to many types of industrial robots 12. Mounting plate 14 is preferably made from steel although other materials known by those skilled in the art may be used. Other plates, brackets, end effectors or other attachment schemes (not shown) may be used.

Figure 5:
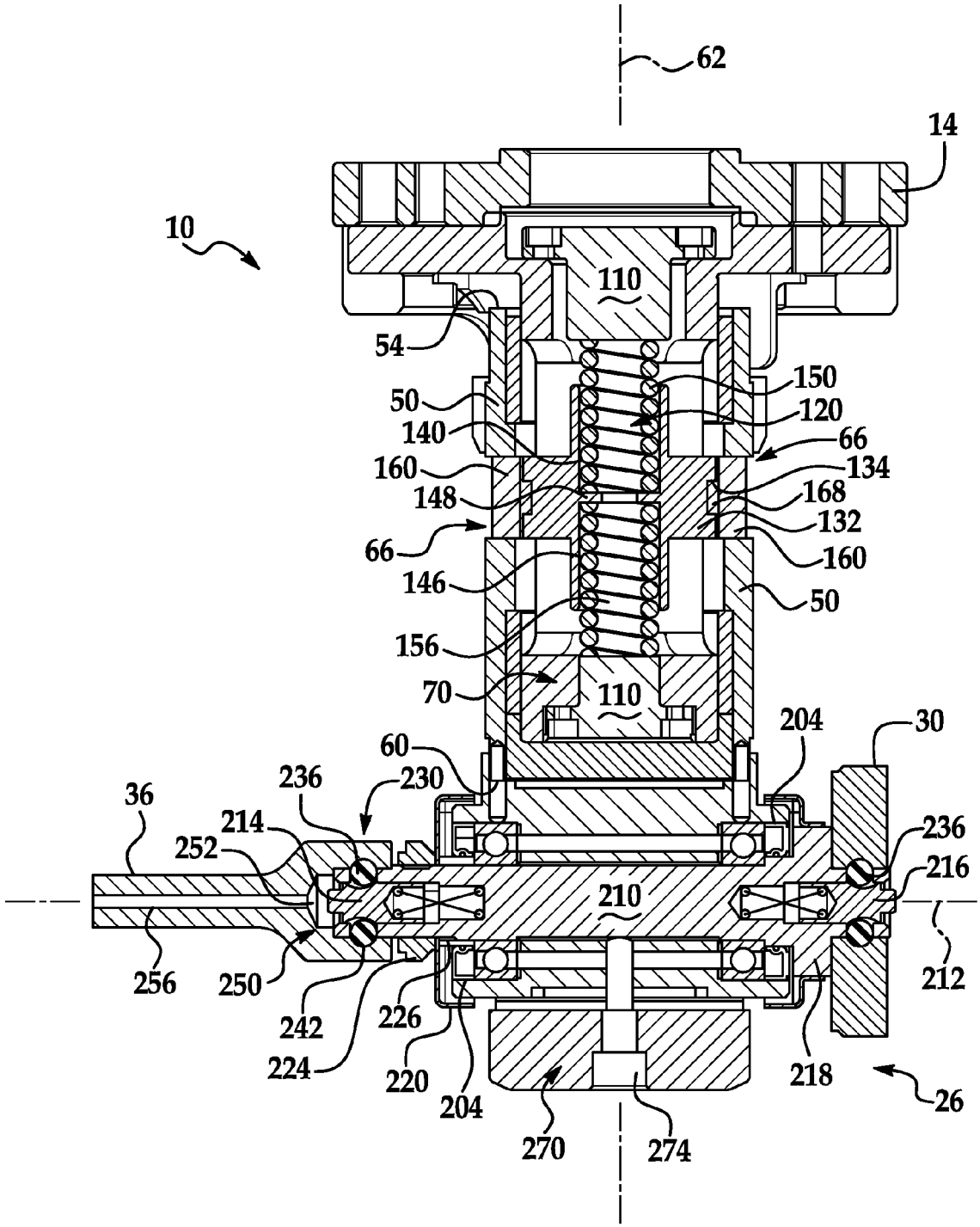
FIG. 5 is an alternate schematic sectional view of the roller head shown in FIG. 2.
Figure 6:
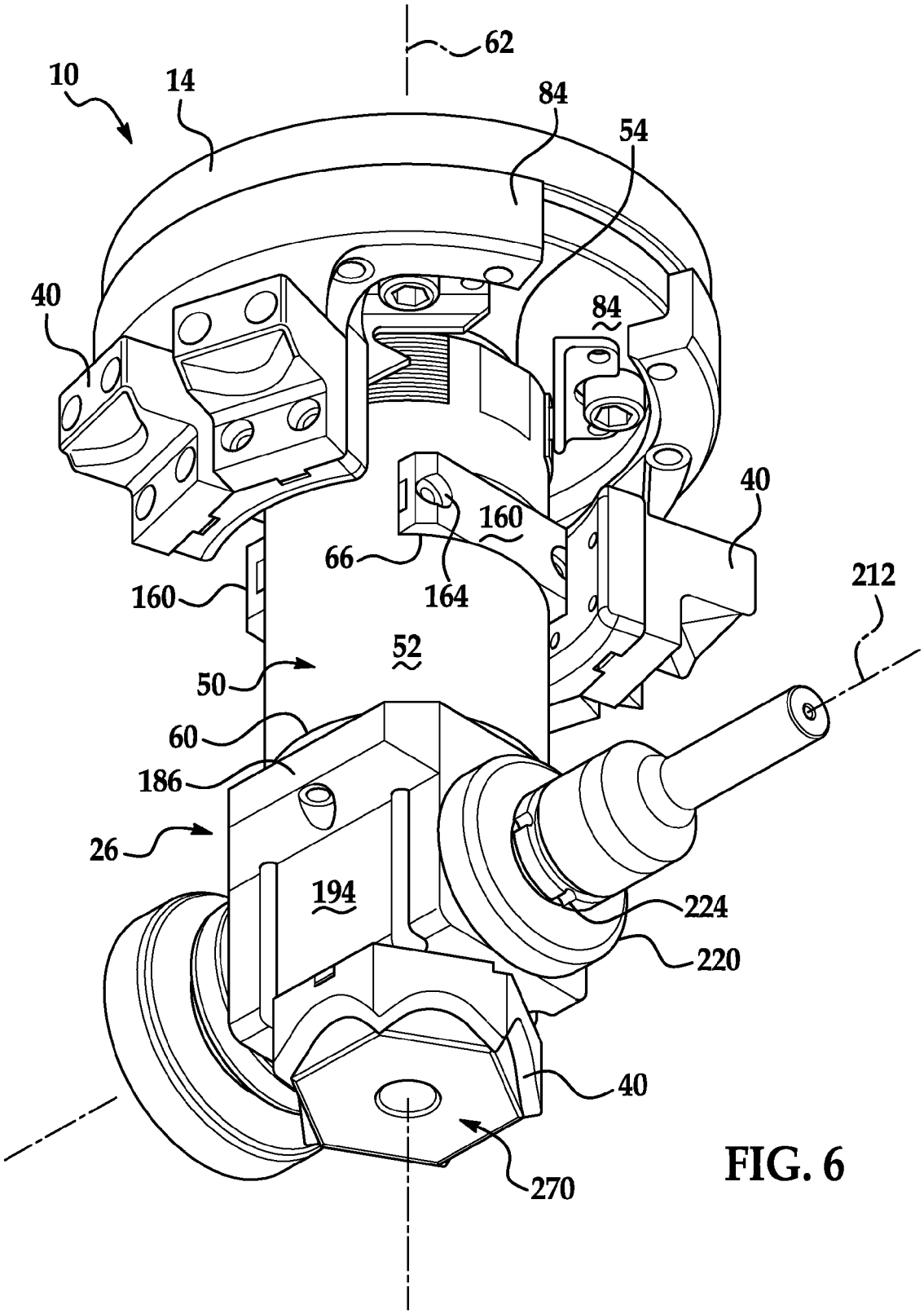
FIG. 6 is a schematic perspective view taken in the direction of A in FIG. 1.

Head 10 further includes a body 20, a bearing retainer 26, a first hemming wheel 30, a second hemming wheel 36 and a plurality of corner form tools 40. In a preferred example as best seen in FIGS. 5 and 6, body 20 includes a cylindrical-shaped housing 50 having an outer surface 52, a first end 54 and a second end 60 separated along a longitudinal axis 62. The housing 50 further includes two diametrically opposed key slots 66 providing through openings through the sidewalls of the housing which define an interior cavity 70 further described below. The housing is preferably made from steel, but other materials, for example aluminum, may be used as known in the art.

Figure 3:
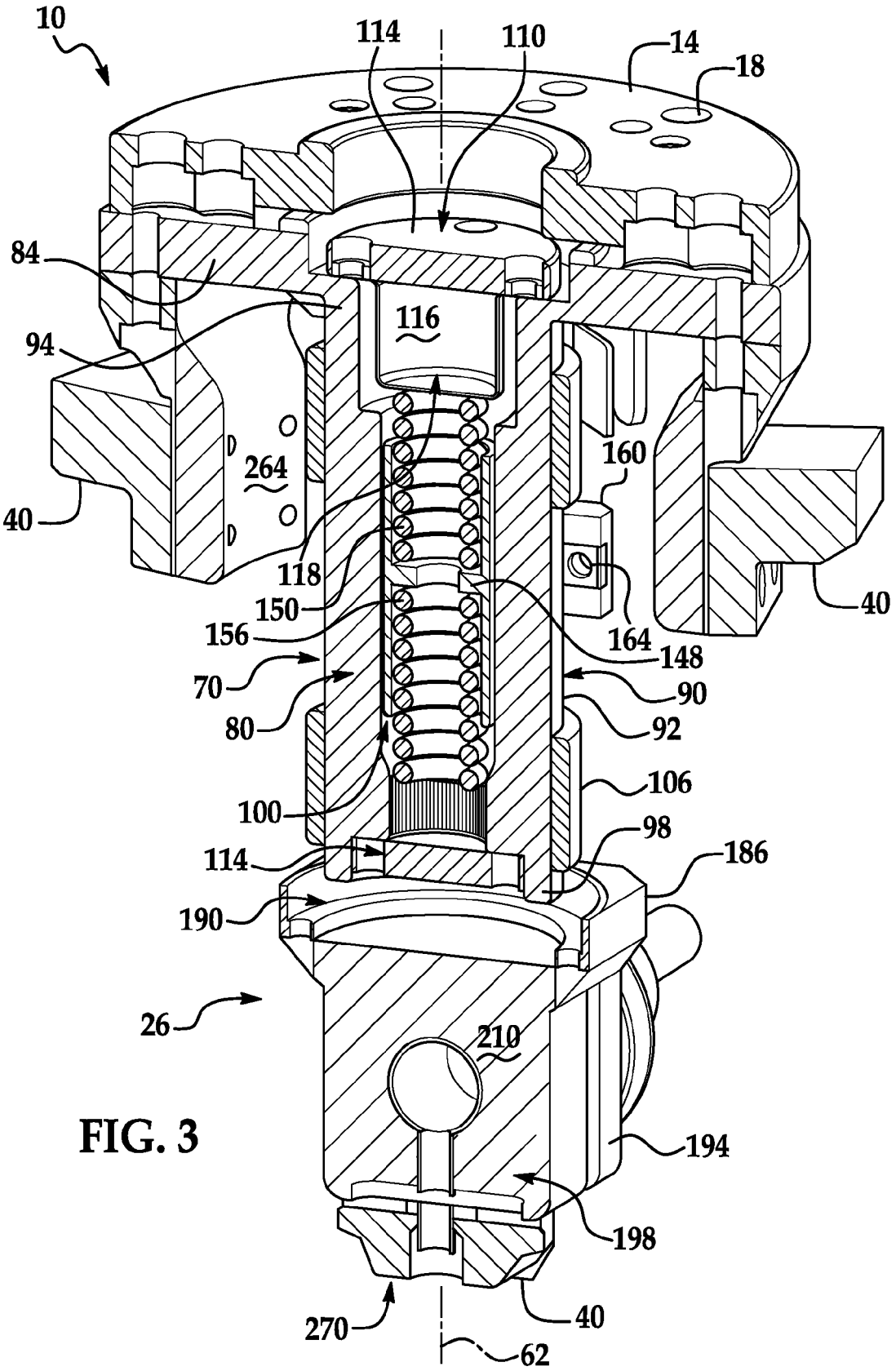
FIG. 3 is a partial schematic sectional view of the roller head shown in FIG. 1 with the body housing removed.

As best seen in FIG. 3, head 10 included a shat 80. In a preferred example, shaft 80 includes an integral cylindrical upper portion 84 and an elongate lower portion 90 positioned concentrically inside of housing 50 in interior cavity 70 along longitudinal axis 62. The upper portion 84 coordinates and is connected to the mounting plate 14 through mechanical fasteners or other connecting devices.

Shaft lower portion 90 includes an outer surface 92, a first end 94 that joins the upper portion 84 and a second end 98 that extends down toward the bearing retainer 26. Outer surface 92 defines an interior cavity 100 extending along axis 62. The lower portion 90 further includes through key slots 102 aligned with the key slots 66 in the housing which are in communication with interior cavity 100. Shaft 80 is preferably made from steel although other materials, for example aluminum, known by those skilled in the art may be used.

Figure 4:
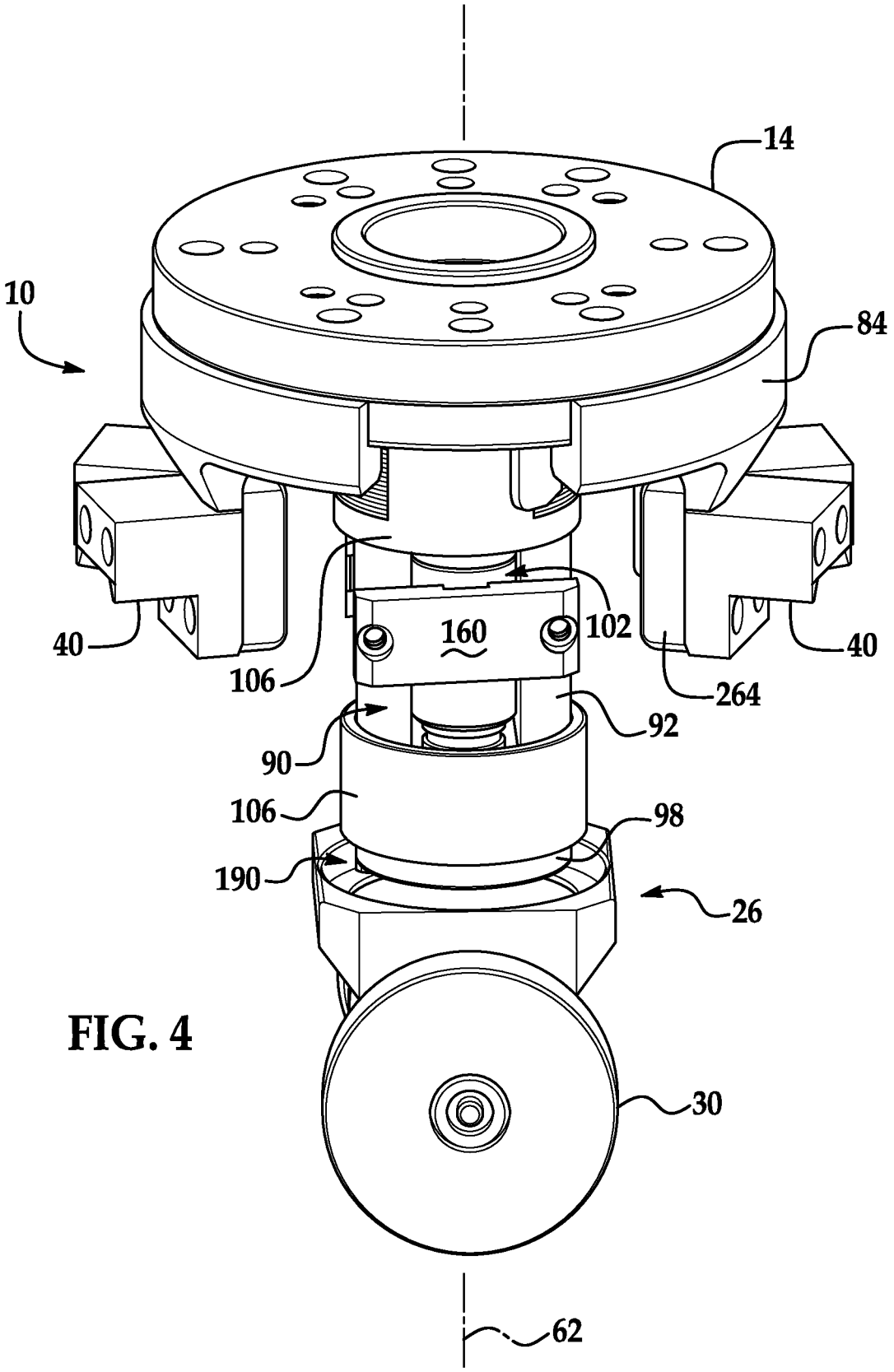
FIG. 4 is a schematic view taken in the direction of C in FIG. 1 with the body housing removed.

As best seen in FIGS. 3 and 4, head 10 includes two cylindrical bushings 106 press-fit onto the outer surface 92 of shaft 80 separated from one another along axis 62 as generally shown. Bushings 106 are positioned in housing interior cavity 70 radially between the shaft outer surface 92 and an interior surface of the housing 50 to contact and guide the housing through relative movement to the shaft as further described below. Bushings 106 are made from a low friction, wear-resistant material such as bronze with a low friction coating, for example RULON, although other materials known by those skilled in the art may be used. Although two bushings 106 are shown, less or more bushings may be used as well as in different locations and orientations to suit the particular application and specification.

Figure 2:
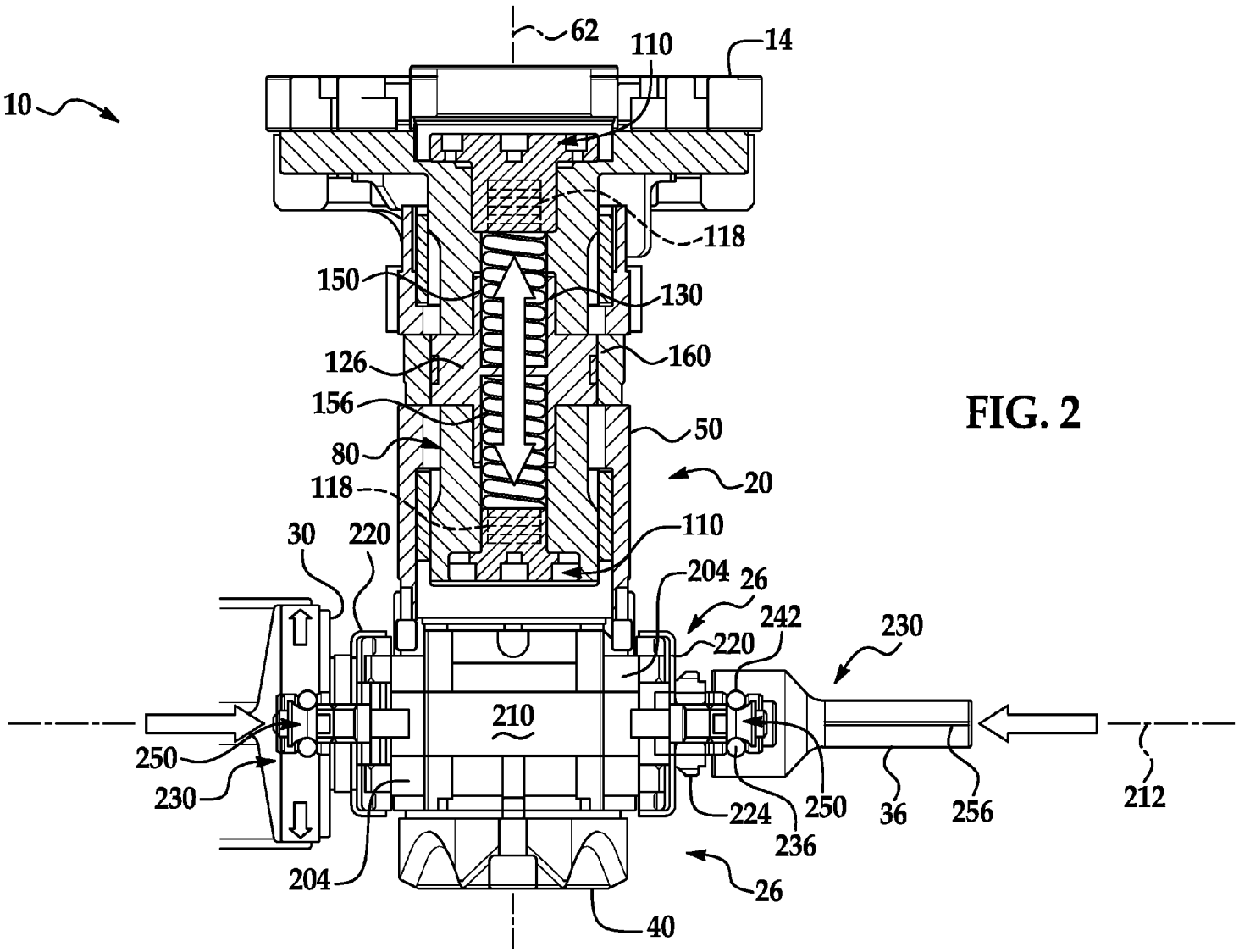
FIG. 2 is a schematic sectional view of the roller head shown in FIG. 1.

As best seen in FIGS. 2 and 3, exemplary head 10 includes a pair of spring preload members 110 respectively positioned at the first 94 and second 98 ends of shaft lower portion 90. Each preload member includes a first portion 114, a second portion 116 and a seat cavity 118. First portion 114 is positioned in a cylindrical relief or counterbore in the upper portion 84 so as to not interfere with mounting plate 14 and second portion 116 extends downward along axis 62 into the shaft interior cavity 100 as best seen in FIG. 3. First portion 114 is connected to upper portion 84 through mechanical fasteners or other suitable connecting methods. The second spring preloader 110 is positioned at the second end 98 of the shaft lower portion 90 and is selectively secured to the lower portion 90 in a similar or equivalent manner as further described below effectively closing shaft interior cavity 100.

As best seen in FIGS. 2, 3 and 5, head 10 includes a preload biasing cartridge 120 which is positioned inside shaft interior cavity 100 as generally shown. In the example shown, preload cartridge 120 includes a cylindrically-shaped spring retainer 126 having an outer surface 130 and an extender portion 132 radially extending outward from axis 62 toward the interior surface of the shaft as best seen in FIG. 5. Extender 132 is positioned and oriented to be aligned with the key slots 66 and 102 in the housing and shaft respectively. Retainer 126 includes a cylindrically-shaped first seat cavity or bore 140 extending downward along axis 62 and a second cylindrically-shaped seat cavity or bore 146 extending upward toward the first seat. The cavity or bores 140 and 146 are separated by a stop 148 that is integral with retainer so the bores do not communicate.

Preload cartridge 120 further includes a first biasing member 150 and a second biasing member 156 positioned respectively in the first cavity seat 140 and second cavity seat 146 along axis 62 as generally shown. In the example, biasing members 150 and 156 are in the form of industrial helical compression springs of selected spring rates suitable for the particular application. Suitable examples of such springs are manufactured by Danly. In one example, a suitable compression spring includes a diameter of about 25 millimeters (mm) and length of about 51 millimeters. In one example, the first 140 and second 146 cavity seats are approximately 26 millimeters in diameter and 35 millimeters deep. The opposite ends of the respective springs are seated in the respective seat cavities 118 in the opposing spring preloader members 110 as generally illustrated. In a preferred example, the length of the first and second biasing members, seated in the spring retainer 126 and spring preload members 110, slightly exceed the length of shaft internal cavity 100. It is understood that different diameters, lengths and spring rates of the biasing members may be used as well as different sizes and depths of the cavity seats. It is further understood that other devices for biasing members 150 and 160 including, pneumatic, hydraulic, elastomeric and other devices and materials may be used.

On installation of the preload cartridge 120 into body 20, the biasing members 150 and 156 are installed into spring retainer 126 and the cartridge is inserted into the shaft internal cavity 100. To enclose the preload cartridge 120, the lower spring preload member 110 is installed at the shaft second end 98. In order to seat and secure spring preload member 110 and encapsulate preload cartridge 120, first and second biasing members are preferably required to be compressed a predetermined amount to apply a force or preload on the first and second biasing member 150 and 156. In one example, the combined preload compression of the first and second biasing members is 3-4 millimeters. Other preload compression forces or linear compression distances may be used to suit the particular application. In an alternate example, there may be no preload or forced compression.

As best seen in FIGS. 5 and 6, in a preferred example, roller head 10 includes two diametrically opposed housing retainers 160. Each retainer 160 includes apertures 164 and a key 168 radially extending inward as best seen in FIG. 5. As best seen in FIG. 6, each retainer 160 is positioned in a respective key slot 66 in the housing 50 such that key 168 extends through the key slots 102 in the shaft and seat into the aligned key slot 134 in the spring retainer 126 as best seen in FIG. 5. On securing the housing retainers 160 through mechanical fasteners to the housing 50, the concentrically oriented housing 50 may reciprocally move along axis 62 relative to shaft 80 and robot 12 once the resistive force of the first 150 and second 156 biasing members is exceeded.

Referring to FIGS. 3, 4 and 5, head 10 includes a bearing retainer 26. Bearing retainer 26 includes a top portion 186 having a radial cavity 190 for abutting receipt of the housing second end 60 as best seen in FIG. 5. Bearing retainer 26 is rigidly secured to the housing 50 such that the bearing retainer reciprocally moves along axis 62 along with housing 50 as generally described above.

As best seen in FIGS. 2 and 5, in the example head 10, bearing retainer 26 includes a hollow housing for encapsulating a pair of sealed bearings 204 spaced apart along an axis of rotation 212. Bearings 204 may be roller, tapered or other bearings known by those skilled in the art. A spindle 210 having a first end 214 and a second end 216 is inserted through and engaged with bearings 204 preventing relative rotational movement between the spindle and the bearings as generally illustrated. Spindle 210 includes a threaded portion (not shown) positioned toward the first end 214 and a radially extending stop 218 adjacent the second end 216 as generally illustrated. As best seen in FIG. 5, a nut 224 is threadibly engaged with the threaded portion of spindle 210 such that the nut 224 and stop 218 are abutting contact with the bearings, preloading the bearings and preventing linear movement of the spindle 210 along axis 212 while permitting free rotation of the spindle about axis 212.

In a preferred example, head 10 further includes a seal cover 220 connected to sealingly engaged with bearing retainer 26 and spindle 210 to prevent unwanted sealer/adhesive, dirt and debris from entering bearing retainer 26. As shown, seal cover 220 may be positioned between nut 224 and bearing spacer 226. Other configurations and orientations of seal covers 220 may be used.

In a preferred example, head 10 includes a hemming wheel quick release device 230 on each end of spindle 210. Each release device 230 includes one or more retractable bearings 236 (two shown) positioned in receptacles in the spindle. The device 230 includes a release mechanism 250 in engagement with the retractable bearings to selectively radially retract the bearings on selected movement of a plunger 252. Linear movement of plunger 252 radially retracts bearings 236. On release of pressure applied to plunger 252, springs or other biasing devices (not shown) bias the bearings 236 back to a normal or default position. In the example shown the spindle 220 and/or hemming wheel includes a bore 256 in communication with the plunger to manually access and actuate the respective plunger. Hemming wheels 30 and 36 each include a through bore for installation of the wheel on the selected spindle end. Each wheel bore includes coordinating receptacles (not shown) for engaging receipt of the retractable bearings 236 to lock the wheel to the spindle preventing relative axial movement between the wheel and the spindle. Other quick release devices 230 and release devices 250 known by those skilled in the art may be used.

In the preferred example shown in FIG. 6, head 10 further includes a plurality of corner forms or corner forming tools 40 positioned and rigidly connected to head 10. Corner forms 40 are useful to forcibly bend and form radiused corners of components in pre-hem or final hem operations during the hemming process. In a preferred example, each corner form 40 includes a different radius to accommodate a different radius on the part, or parts, to be hemmed or worked. As illustrated several corner forms 40 can be mounted to supports 264 connected to shaft upper portion 84 as best seen in FIGS. 4 and 6. In this position, the corner forms are advantageously rigidly connected to shaft 80 and robot 12 to avoiding relative movement between the corner forms and the robot 12. This also positions the corner forms 40 closer to the mounting plate 14 reducing force arms and torques created by pressure on the corner forms when in use.

Figure 7:
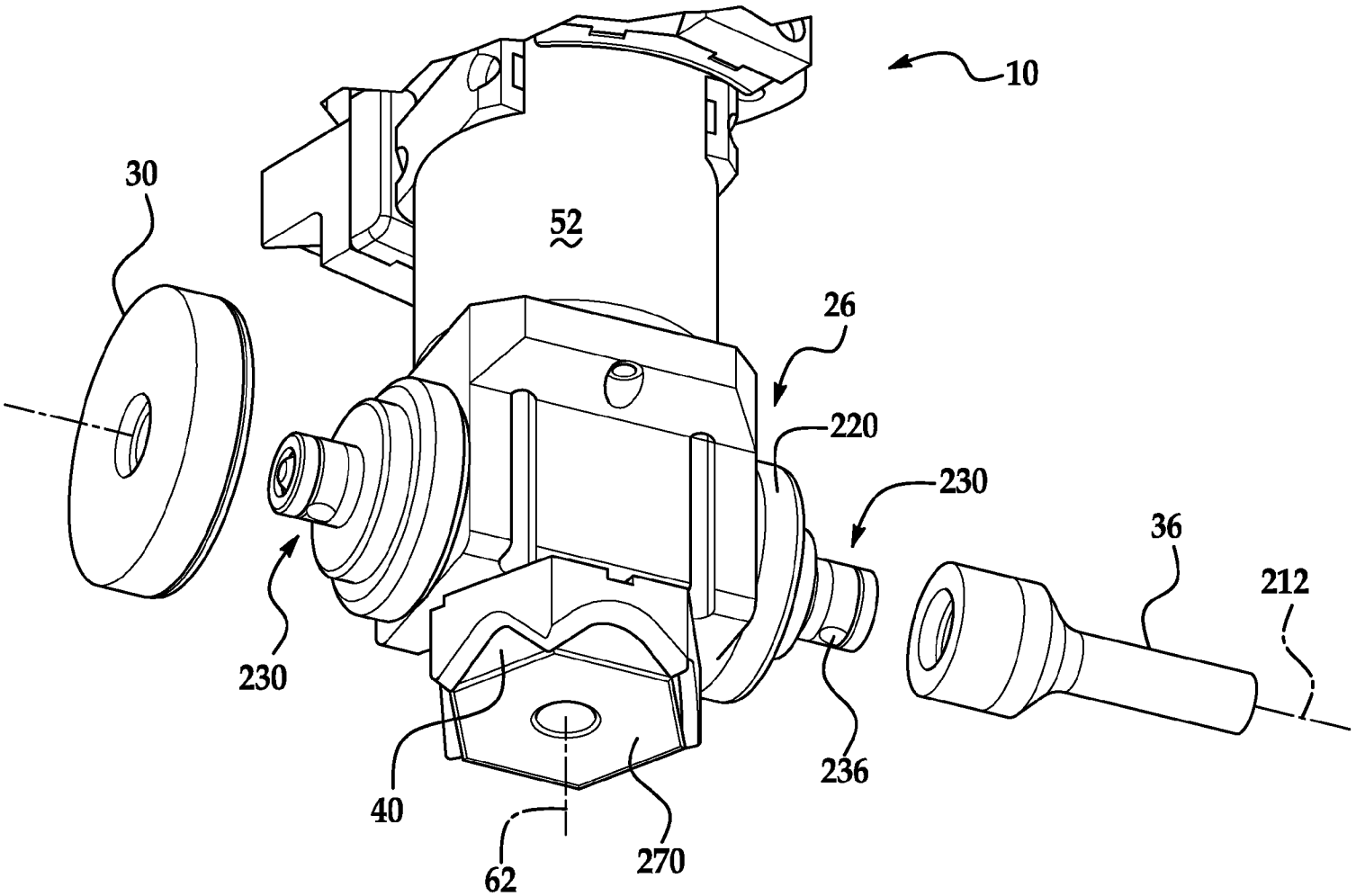
FIG. 7 is a schematic perspective partially exploded view taken in the direction of B shown in FIG. 1.

In the example as best illustrated in FIGS. 6 and 7, a cap 270 including several corner forms 40 radially separated about axis 62 are rigidly connected to the bottom of bearing retainer 26 through one or more fasteners 274. In a preferred aspect, ten (10) different corner forms 40 are used with each head 10 although greater or lesser numbers may be used or multiples of the same corner form may be used as known by those skilled in the field. Other locational position and orientations of corner forms 40 with respect to head 10 may be used as known by those skilled in the art.

As best seen in FIGS. 1 and 2, the exemplary hemming rollers 30 and 36 are shown. In the example, first wheel 30 is preferably about 90 millimeters (mm) in diameter and second wheel 36 is about 14 millimeters (mm) in diameter. It is understood that different diameters, orientations and shapes of the wheels may be used to suit the particular application. For example, second wheel 36 may take a conical or tapered form or construction versus a cylindrical shape as shown. Wheels 30 and 36 are preferably made from hardened tool steel exhibiting good wear and strength characteristics. Other materials known by those skilled in the art may be used.

Figure 8:
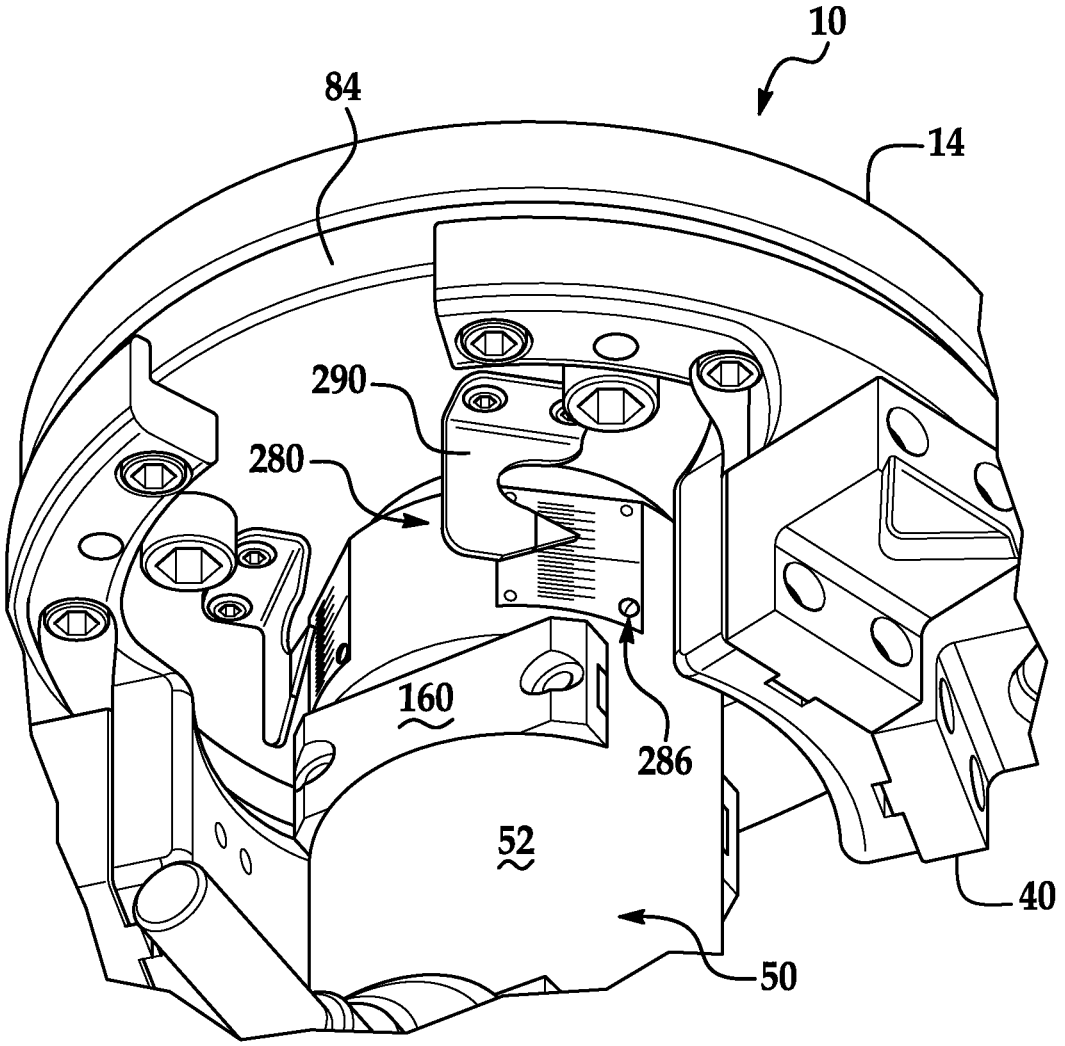
FIG. 8 is a schematic perspective view of an example of a force gauge used with the roller head shown in FIG. 1.

Referring to FIG. 8, an example of a gauge 280 is used to measure or monitor the travel and/or force of the wheels 30 and 36 in a production operation. Exemplary gauge 280 includes graduation markings or a scale 286 positioned on the housing outer surface 52, preferably calibrated for the desired measurement to be taken, for example travel in millimeters of force in pounds. Gauge 280 further includes an indicator or needle 290 mounted to the underside of shaft upper portion 84 as generally shown. Indicator 290 is positioned in close proximity to scale 286 to easily indicate or mark the present reading along scale 286. One or more gauges 280 may be used about the circumference of housing 50 or located in other areas to reflect the relative positions between housing 50 and shaft 80. Although shown as a mechanical gauge, it is contemplated that gauge 280 may take the form of an electronic gauge for electrically measuring and/or monitoring the relative position as described above. An electronic gauge may be placed in electronic communication with a visual readout or send data signals to a remote station where the data can be monitored and stored for historical data over a shift or time period. Other gauges known by those skilled in the art may be used.

In an exemplary application or operation, for example hemming the edge around an automotive door panel, roller head 10 would be mounted to an industrial robot 12, by mounting plate 14 through conventional fasteners or other means. Where use of roller head 10 is in a push application, in other words, a compressive force applied from the robot to the selected wheel 30 or 36, the robot exerts a principally axial force along axis 62 to shaft 80 through shaft upper portion 84 and spring preloader 110 in abutting contact with first biasing member 150. The force is transmitted through spring preloader 110 further compressing first biasing member 150 applying a downward force on stop 148, the spring retainer 126 and connected housing retainers 160. The extenders 132 transfer the downward force radially outward through to housing retainers 160 down through the housing 50 and bearing retainer 26 to the selected hemming wheel 30 or 36 to the hem joint in the component to be formed (not shown). As explained, there is preferably a preload in the preload cartridge 120, for example in an amount of about 3-4 millimeters. During a hemming operation, force is applied to compress the first bias member 150 about 5 millimeters. The clearance between the upper end of the spring retainer and shaft upper portion 84 affords approximately 12 millimeters of maximum travel. Other clearances and lengths of travel known by those skilled in the art may be used.

In an alternate pull-type application where second wheel 36 is positioned in, for example, an interior channel of a door window opening, the robot would instead pull the wheel 36 in a direction toward the mounting plate 14. In this instance, shaft 80 and attached mounting plate 14 would be axially drawn or forced in a direction generally along axis 62 away from wheel 36. The axial force would be transferred through bearing retainer 26, through housing 50, through housing retainer 160 to the spring retainer 126 and through shaft 80. The resistance of movement of wheel 36 in the direction of axis 62 is absorbed through spring retainer 126 and stop 148 and compresses second biasing member 156. The clearance between shaft second end 98 and the lower inner surface of housing 50 is approximately 12 millimeters affording 12 millimeters of maximum travel. The present design is useful in both compression (push) and tension (pull) type operations when used in a hemming operation.

Figure 9:
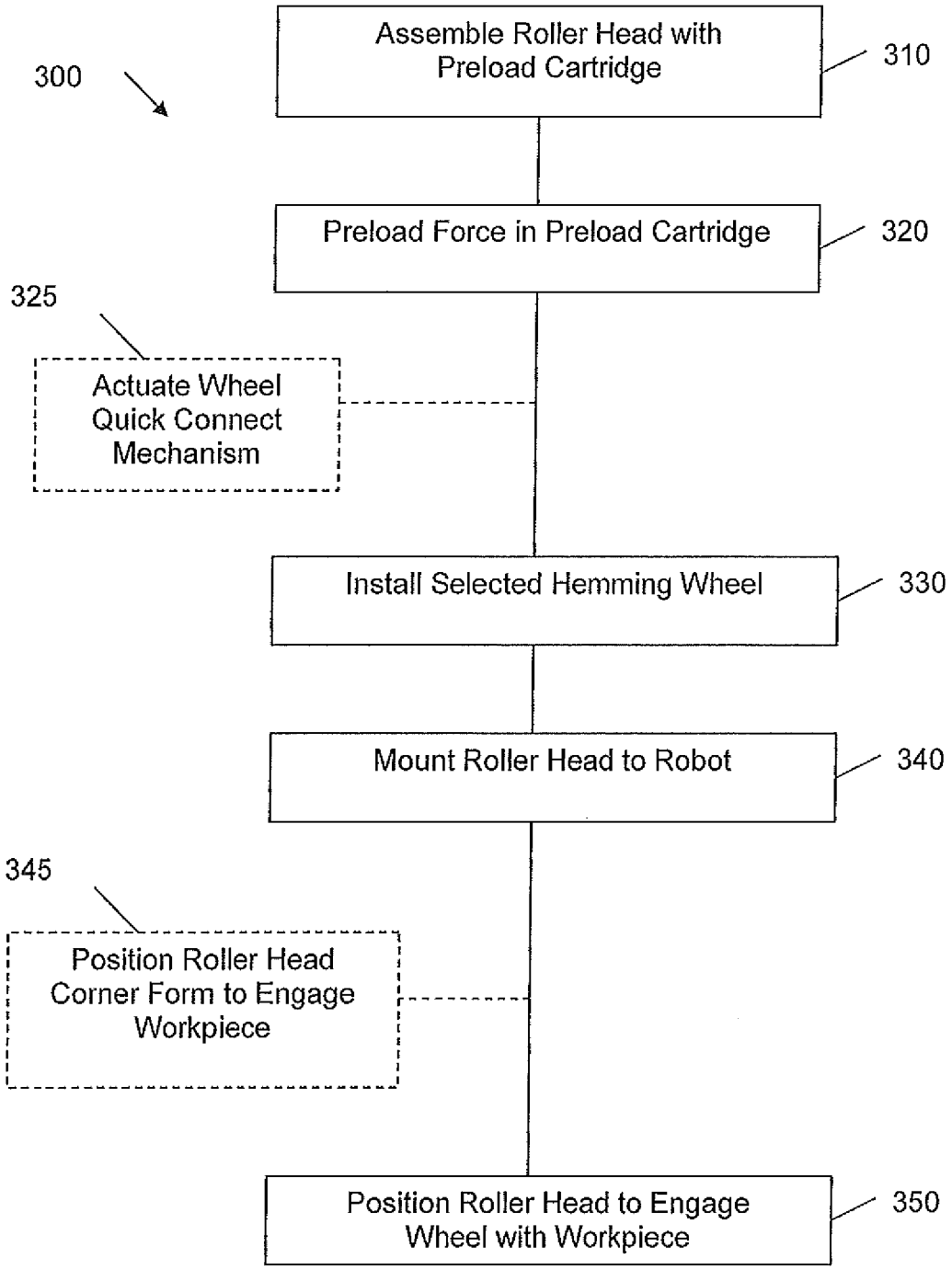
FIG. 9 is a schematic flow chart of an example of the inventive process to assemble a hemming roller head.

Referring to FIG. 9 an example process 300 for using head 10 is schematically illustrated. In the example step 310, head 10 is assembled with a selected preload cartridge having selected biasing members appropriate for the hemming or forming operation. The preload cartridge is mounted and secured in shaft cavity 100 and compressed creating a preload in the biasing members as described above in step 320. The housing 50 is installed concentrically about the shaft 80 and is secured to the spring retainer 126 through housing retainer 160 allowing relative axial movement between the shaft 80 and the housing 50 against the preload force in the preload cartridge 120.

The bearing retainer is secured to the housing 50 and the hemming wheel or wheels are selected for the application. In step 330 the hemming wheels are connected to the appropriate end of the spindle through actuation and engagement of quick connect mechanism 230 to complete assembly of the head 10.

In step 340, the head 10 is mounted to a robot or other articulating force application device in step 310. The robot is connected to a programmable controller having a preprogrammed path of travel.

In step 350 the hemming roller is positioned along the programmed path of travel until the selected wheel is placed in forcible contact with the component to be hemmed or worked. Due to the preload in the preload cartridge, forcible contact of the head 10 hemming wheel to the workpiece does not require additional axial movement to compress the spring or biasing member to an appropriate axial compression to accommodate variations in the travel of the hemming wheel so as to maintain a suitable force to work the material unlike prior designs. The preload condition or step substantially eliminates any upward lift or tendency to raise the hemming wheel due to the higher resistance force from the material up to its yield point. The preload prevents this condition and allows the hemming roller to move directly to the optimum position with respect to the workpiece to begin the rolling portion of the hemming process.

In an alternate step 345, one of the plurality corner forms 40 are first used force or work a radiused corner on the workpiece. The same preload condition is also an advantage in corner forming to prevent or substantially eliminate raising or lifting of the corner portion on forcible contact with the workpiece. Another advantage of having a plurality of different corner forms on head 10 is that multiple different radii on a component can be formed for more efficient processing to reach the roller hemming portion of the hemming process.

In an alternate step 325, one or more of the hemming wheels are removed and replaced with the quick connect device 230. The release device 250 is accessed and actuated retracting the bearings allowing easy removal of the wheel and replacement with the same or an alternate wheel. In one example, the quick connect release device 250 and plunger 252 is actuated by an automated robot or other mechanism to disengage the device so the wheel can be removed. In an alternate example, the release device 250 is accessed and actuated manually by an operator. The quick connect mechanism 230 is particularly useful when the roller head 10 is positioned in an assembly cell along an assembly line where there is numerous build or vehicle change over requiring changing of hemming wheels to accommodate different components and geometries to be formed.

Figure 10:
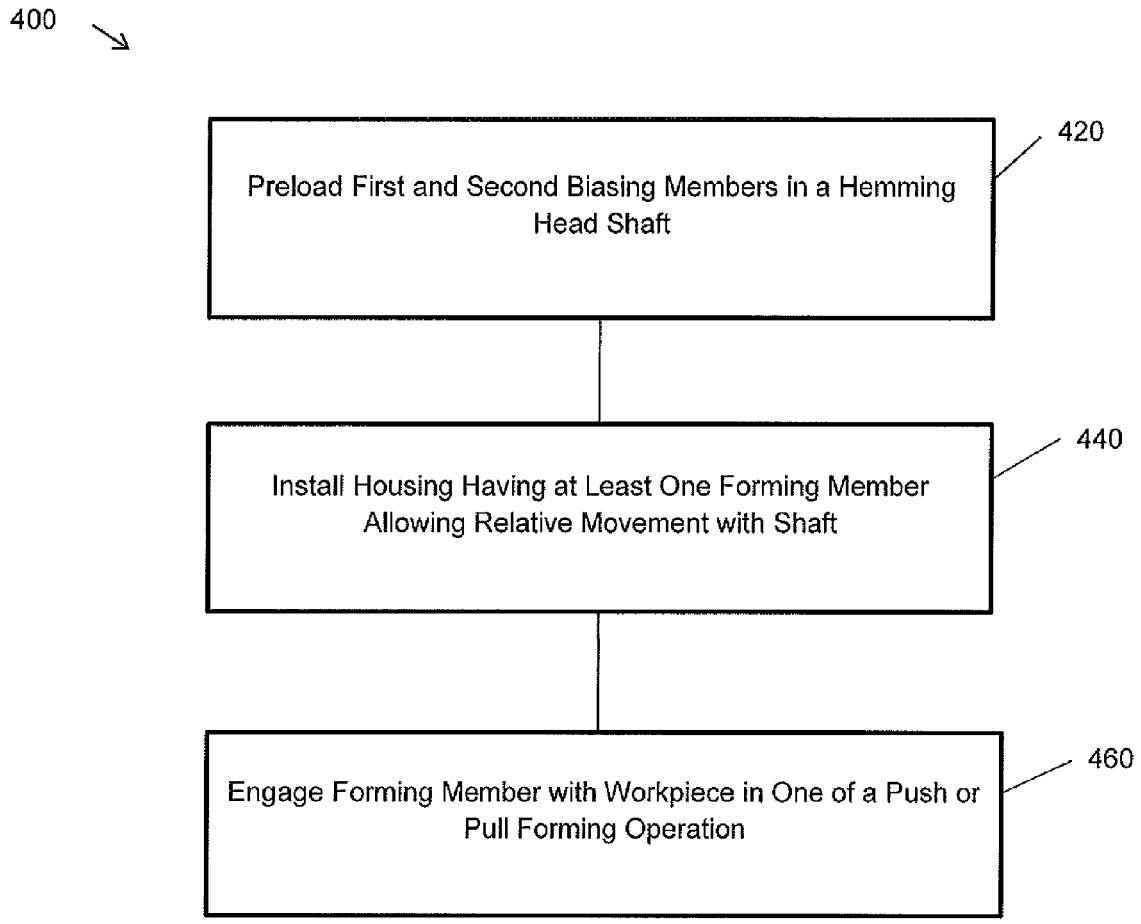
FIG. 10 is a schematic flow chart of an example hemming process using the disclosed hemming head invention.

Referring to FIG. 10, an example of a method for hemming in a push or pull hemming operation 400 is illustrated. In the example, in a first step 420 a preload is applied to a first 150 and a second 156 biasing member in a shaft 80 of a hemming head 10.

In step 440, a forming member, for example a hemming wheel 30 or 36, or a corner form 40, is connected to the housing 50 which allows relative movement between the forming member and the shaft 80. In the example described above, the forming member can be connected to a bearing retainer 26 through a quick connect or release device 230 or other ways described above.

In step 460, the forming member, for example a hemming wheel 230 for exterior joints is positioned to abuttingly engage the work piece joint, wherein one of the first or the second preloaded biasing members 150 or 156 serves to assist in keeping the hemming wheel in contact with the workpiece throughout the hemming process or path of travel of the wheel. As disclosed above, the process is useful in forming operations on exterior or interior edge or joint applications.

Additional or alternate steps, and execution in alternate orders, may be used as known by those skilled in the art.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A hemming device for use in a metal forming operation on a workpiece, the hemming device comprising:

a mounting plate adapted to be connected to an industrial robot;

an elongate shaft extending along a longitudinal axis and connected to the mounting plate, the shaft having an elongate radial wall positioned between the mounting plate and a shaft lower portion opposite the mounting plate, the elongate radial wall defining an internal cavity and at a pair of through keyhole slot opening diametrically opposed in the shaft radial wall positioned between the mounting plate and the shaft lower portion, the shaft keyhole slots in communication with the internal cavity;

a preload cartridge having a first biasing member seat and a second biasing member seat separated by a stop, the cartridge positioned in shaft internal cavity and movable relative to the shaft along the longitudinal axis;

a first biasing member positioned in the first biasing member seat extending toward the mounting plate;

a second biasing member positioned in the second biasing member seat extending toward the shaft lower portion;

a housing positioned radially outward and concentric about at least a portion of the shaft, the housing movable relative to the shaft, the housing defining a pair of keyhole slots in communication with the shaft interior cavity and aligned with the cartridge;

a first housing retainer and a second housing retainer, each housing retainer connected to the cartridge through the aligned keyhole slots in the shaft and the housing, the second housing retainer diametrically opposed to the first housing retainer relative to the longitudinal axis; and a workpiece forming member connected to the housing, wherein on application of a downward force to the shaft from the mounting plate toward the forming member the first biasing member is compressed and wherein on application of a pulling force to the forming member the second biasing member is compressed, each biasing member compression providing a range of movement of the forming member along the longitudinal axis while maintaining a substantially constant force between the forming member and a workpiece.

2. A hemming device for use in a metal forming operation on a workpiece, the hemming device comprising:

an elongate shaft extending along a longitudinal axis, the shaft having an elongate radial wall positioned between a shaft upper portion and a lower portion of the shaft, the elongate radial wall defining an internal cavity and a first and a second through opening in the radial wall positioned between the upper portion and the lower portion and diametrically opposed to one another about the longitudinal axis in communication with the internal cavity;

a cartridge having a stop positioned in shaft internal cavity, the cartridge movable relative to the shaft along the longitudinal axis;

a first biasing member engaged with the cartridge;

a second biasing member engaged with the cartridge;

a housing connected to the cartridge through the shaft radial wall through opening and movable with the cartridge along the longitudinal axis relative to the shaft, the housing defining a first and a second key slot diametrically opposed to one another about the longitudinal axis and aligned with the respective shaft first and second radial wall through openings;

a first housing retainer and a second housing retainer diametrically positioned from each other relative to the longitudinal axis, each of the first and the second housing retainers respectively connected to the housing and extending through one of the respective aligned first or second key slot and respective first or second shaft radial wall through opening, each of the first and the second retainers respectively connecting to the cartridge thereby rigidly connecting the housing to the cartridge for movement of the cartridge and housing along the longitudinal axis relative to the shaft; and a workpiece forming member connected to the housing, wherein on application of a force to the shaft, one of the first or the second biasing members provides a biasing resistive force to maintain the forming member in contact with the workpiece.

3. A hemming device for use in a metal forming operation on a workpiece, the hemming device comprising:

an elongate shaft extending along a longitudinal axis, the shaft having an elongate radial wall positioned between a shaft upper portion and a lower portion of the shaft, the elongate radial wall defining an internal cavity and at least one through opening in the radial wall positioned between the upper portion and the lower portion in communication with the internal cavity;

a cartridge having a stop positioned in shaft internal cavity, the cartridge movable relative to the shaft along the longitudinal axis;

a first biasing member engaged with the cartridge;

a second biasing member engaged with the cartridge;

a housing connected to the cartridge through the shaft radial wall through opening and movable with the cartridge along the longitudinal axis relative to the shaft, the housing positioned radially outward of and substantially concentric around the shaft relative to the longitudinal axis;

a gauge for indicating one of the position of the shaft relative to the housing along the longitudinal axis or the biasing resistive force by the first or the second biasing members, the gauge further comprising:

a gauge first portion connected to the shaft upper portion and extending downward to overlap a portion of the housing; and a gauge second portion having measurement indicia thereon, the gauge first portion position relative to the measurement indicia provides data on the relative linear position of the housing relative to the shaft along the longitudinal axis; and a workpiece forming member connected to the housing, wherein on application of a force to the shaft, one of the first or the second biasing members provides a biasing resistive force to maintain the forming member in contact with the workpiece.

4. The hemming device of claim 1 further comprising a shaft upper portion, the shaft upper portion further comprising a radial mounting surface.

5. The hemming device of claim 2 wherein the cartridge further comprises an elongate member defining a first seat cavity for receipt of the first biasing member and a second seat cavity for receipt of the second biasing member, the first and second seat cavities separated by the stop abuttingly engaging the first and the second biasing members.

6. The hemming device of claim 1 wherein the shaft further comprises at least one spring preload member connected to the shaft to at least partially enclose the shaft internal cavity and the first and the second biasing members.

7. The hemming device of claim 6 wherein the spring preload member is positioned along the longitudinal axis to abuttingly engage and apply a compressive preload force on at least one of the first or the second biasing members along the longitudinal axis when the preload member is fully secured to the shaft.

8. The hemming device of claim 1 further comprising a bearing retainer connected to the housing, the forming member connected to the bearing retainer.

9. The hemming device of claim 8 wherein the bearing retainer further comprises a spindle rotatably connected to the bearing retainer, the spindle having a first end and a second end extending from opposing sides of the bearing retainer.

10. The hemming device of claim 9 wherein the forming member comprises a first hemming wheel connected to the spindle first end and a second hemming wheel connected to the spindle second end.

11. The hemming device of claim 8 wherein the bearing retainer further comprises a quick connect forming member device for rapid attachment or disengagement of the forming member from the bearing retainer.

12. The hemming device of claim 1 further comprising a plurality of corner forms connected to at least one of a bearing retainer or the shaft upper portion.

13. The hemming device of claim 11 wherein the quick connect forming member device further comprises:

at least one retractable ball bearing positioned in a spindle; and a release mechanism in engagement with the at least one retractable ball bearing to selectively radially retract the at least one ball bearing to allow for disengagement of the forming member from the spindle.

14. The hemming device of claim 1 wherein the forming member further comprises a first forming tool and a second forming tool, each of the first and the second forming tools rotatably mounted about opposing ends of a spindle.

15. The hemming device of claim 2 further comprising a bearing retainer having a spindle, the bearing retainer connected to the housing, the forming member connected to the bearing retainer.

16. The hemming device of claim 15 wherein the bearing retainer further comprises a quick connect forming member device for rapid attachment or disengagement of the forming member from the bearing retainer.

17. The hemming device of claim 16 wherein the quick connect forming member further comprises:

at least one retractable ball bearing positioned in the spindle; and a release mechanism in engagement with the retractable ball bearing to selectively radially retract the ball bearing to allow for disengagement of the forming member from the spindle.

* * * * *